US009677753B2

(12) United States Patent
Breidenassel

(10) Patent No.: US 9,677,753 B2
(45) Date of Patent: Jun. 13, 2017

(54) LIGHTING DEVICE HAVING AT LEAST ONE HEAT SINK

(75) Inventor: Nicole Breidenassel, Bad Abbach (DE)

(73) Assignee: OSRAM GmbH, Munich (DE)

( * ) Notice: Subject to any disclaimer, the term of this patent is extended or adjusted under 35 U.S.C. 154(b) by 271 days.

(21) Appl. No.: 13/254,853

(22) PCT Filed: Mar. 3, 2010

(86) PCT No.: PCT/EP2010/052648

§ 371 (c)(1),
(2), (4) Date: Nov. 9, 2011

(87) PCT Pub. No.: WO2010/100169

PCT Pub. Date: Sep. 10, 2010

(65) Prior Publication Data

US 2012/0044707 A1 Feb. 23, 2012

(30) Foreign Application Priority Data

Mar. 5, 2009 (DE) ..... 10 2009 011 350

(51) Int. Cl.
*F21K 2/00* (2006.01)
*F21V 29/74* (2015.01)
(Continued)

(52) U.S. Cl.
CPC ..... *F21V 29/74* (2015.01); *F21K 9/232* (2016.08); *F21V 29/02* (2013.01); *F21V 29/60* (2015.01); *F21V 29/677* (2015.01); *F21V 29/745* (2015.01); *F21V 29/75* (2015.01); *F21V 29/76* (2015.01); *F21V 29/77* (2015.01); *F21V 29/80* (2015.01); *F21V 29/83* (2015.01); *F21Y 2115/10* (2016.08)

(58) Field of Classification Search
CPC .... F21V 29/004; F21V 29/22; F21V 29/2206; F21V 29/00; F21V 29/74; F21V 29/75; F21V 29/76; F21V 29/77; F21V 29/777; F21V 29/767
USPC ..... 362/650, 294, 373, 249.01–249.02
See application file for complete search history.

(56) References Cited

U.S. PATENT DOCUMENTS 7,246,919 B2 * 7/2007 Porchia et al. ..... 362/276
7,575,346 B1 8/2009 Horng et al.
(Continued)

FOREIGN PATENT DOCUMENTS

CN 201110529 Y 9/2008
DE 202007002751 U1 4/2007
(Continued)

OTHER PUBLICATIONS

English abstract of DE 102007037862 A1.
(Continued)

*Primary Examiner* — Sean Gramling
*Assistant Examiner* — Gerald J Sufleta, II
(74) *Attorney, Agent, or Firm* — Viering, Jentschura & Partners mbB

(57) ABSTRACT

In various embodiments, a lighting device may include at least one heat sink and a base configured to accommodate at least one light source and at least one device connected to the lighting device configured to generate a cooling media flow, wherein the cooling media flow runs predominantly parallel to the plane of the base of the heat sink.

20 Claims, 4 Drawing Sheets

(51) Int. Cl.

| | |
|---|---|
| ***F21V 29/60*** | (2015.01) |
| ***F21V 29/80*** | (2015.01) |
| ***F21V 29/02*** | (2006.01) |
| ***F21V 29/67*** | (2015.01) |
| ***F21V 29/75*** | (2015.01) |
| ***F21V 29/76*** | (2015.01) |
| ***F21V 29/77*** | (2015.01) |
| ***F21V 29/83*** | (2015.01) |
| ***F21K 9/232*** | (2016.01) |
| *F21Y 115/10* | (2016.01) |

(56) References Cited

U.S. PATENT DOCUMENTS

| | | | | |
|---|---|---|---|---|
| 8,390,207 | B2 * | 3/2013 | Dowling et al. | 315/186 |
| 2005/0174780 | A1 * | 8/2005 | Park | 362/294 |
| 2007/0253202 | A1 * | 11/2007 | Wu | F21V 29/006 362/294 |
| 2007/0297183 | A1 | 12/2007 | Coushaine | |
| 2008/0037226 | A1 * | 2/2008 | Shin | F21K 9/00 361/720 |
| 2008/0123340 | A1 * | 5/2008 | McClellan | 362/294 |
| 2008/0149305 | A1 * | 6/2008 | Chen | F21K 9/00 165/80.3 |
| 2009/0052175 | A1 | 2/2009 | Xu et al. | |
| 2009/0059559 | A1 * | 3/2009 | Pabst et al. | 362/84 |
| 2009/0251901 | A1 * | 10/2009 | Kuo | F21K 9/00 362/294 |
| 2009/0268468 | A1 * | 10/2009 | Liu | 362/294 |
| 2010/0002453 | A1 * | 1/2010 | Wu | F21V 3/00 362/373 |
| 2010/0207534 | A1 * | 8/2010 | Dowling et al. | 315/186 |
| 2010/0219734 | A1 * | 9/2010 | Lenk | F21V 29/004 313/35 |

FOREIGN PATENT DOCUMENTS

| | | | |
|---|---|---|---|
| DE | 202008000360 | U1 | 5/2008 |
| DE | 102007037862 | A1 | 10/2008 |
| DE | 102007036486 | A1 | 2/2009 |
| DE | 102007040444 | A1 | 3/2009 |
| EP | 2128522 | A1 | 2/2009 |
| JP | 2004296245 | A | 10/2004 |
| JP | 2008186758 | A | 8/2008 |

OTHER PUBLICATIONS

English abstract of DE 10 2007036486 A1.
English machine translation of DE 202008000360 U1.
English abstract of DE 202007002751 U1.
English abstract of JP 2004296245 A.
Espacenet Translation of the abstract of CN201110529 (Y) dated Jun. 19, 2013.
Chinese Office Action; issued Oct. 22, 2013; 6 pages.
European Office Action dated Jan. 13, 2014.

* cited by examiner

LIGHTING DEVICE HAVING AT LEAST ONE HEAT SINK

RELATED APPLICATIONS

The present application is a national stage entry according to 35 U.S.C. §371 of PCT application No.: PCT/EP2010/052648 filed on Mar. 3, 2010, which claims priority from German application No.: 10 2009 011 350.9 filed on Mar. 5, 2009.

TECHNICAL FIELD

The invention relates to a lighting device having at least one heat sink and an at least approximately flat base for accommodating at least one light source and at least one device connected to the lighting device for generating a cooling media flow, in particular an air flow.

BACKGROUND

Lighting devices, in particular when said lighting devices use light-emitting diodes (LEDs) for generating light, frequently require a cooling device by which the light sources are able to be cooled during operation, so that said light sources have a long service life and the desired lighting quality is achieved. To this end, the cooling devices generally have a preferably flat base, the LEDs being directly attached to said base or to a suitable support.

With higher outputs, passive heat sinks are no longer sufficient to ensure the desired cooling action and generally devices are used for generating a cooling media flow, which improve the dissipation of the heat output by convection. In the simplest and most common form, electrical fans which are mounted on the side of the heat sink remote from the base are used for this purpose and blow ambient air as cooling fluid approximately perpendicular to the heat sink. The cooling air flow is thus guided perpendicular to the plane of the base onto the heat sink and deflected to the side when it comes into contact with said heat sink.

Due to the deflection of the cooling air flow, greater pressures and lower flow rates result, whereby poor cooling action is achieved. If additionally the air flow is not accurately guided perpendicular to the heat sink, for example due to a slightly oblique position of the fan in relation to the heat sink, the uneven discharge of air may lead to an uneven cooling of the heat sink and thus to an undesirably uneven temperature distribution.

An optimal cooling action is particularly important in so-called retrofit lamps, which have light-emitting diodes as light sources and a conventional lamp base in order to be able to use light-emitting diodes instead of conventional incandescent lamps. Said retrofit lamps are intended to correspond in their external dimensions as closely as possible to conventional incandescent lamps and, therefore, have to have a particularly compact design and operate as far as possible in all installation positions. This promotes the occurrence of a thermal short circuit, i.e. the heated-up cooling air which has just been blown out is immediately drawn back in, particularly when the lamps are operated in spatially restricted conditions, for example due to a lamp shade.

SUMMARY

Various embodiments provide a lighting device having at least one heat sink and a base for accommodating at least one light source and at least one device connected to the lighting device for generating a cooling media flow, e.g. an air flow, which has a compact construction and a high degree of efficiency when the light source is cooled.

As the cooling media flow runs predominantly parallel to the plane of the base of the heat sink, a deflection of the air flow by a greater angle, in particular by more than 90°, is avoided. As a result, the cooling action is substantially increased with the same ventilation efficiency relative to an embodiment according to the prior art. Additionally, in such an arrangement, the flow path and thus the cooling action is able to be predicted more easily and is also substantially less sensitive relative to faulty positioning of the fan. In this case, the region of the heat sink may be regarded as the base which is provided for fastening components. Expediently, said base is at least approximately flat, as a particularly simple arrangement is thus achieved in which, for example, light-emitting diodes premounted on support plates may be used. However, bases of convex shape are also conceivable. In said bases, the plane is understood as the plane in which all the distances between the points of the base which are located above the plane are equal to all the distances between the points of the base which are located below the plane.

When the lighting devices are exclusively arranged on a base of the heat sink, a particularly simple design is achieved.

It is particularly advantageous if the cooling media flow runs substantially from a lateral surface of the lighting device to the opposing lateral surface of the lighting device. By means of this path of the cooling media flow, a particularly large distance is created between the inlet of the cooling media and the outlet of the cooling media from the lighting device and thus the heated-up coolant is prevented from being drawn in again (a so-called thermal short-circuit). This is advantageous, in particular with the use of ambient air as coolant, as ambient air is particularly difficult to control compared with other cooling media. In this case, in particular the outer boundaries of the lighting device may be regarded as the lateral surfaces, which are arranged perpendicular to a main direction of radiation of the light sources or perpendicular to a longitudinal axis of the lighting device. In retrofit lamps, said lateral surfaces are generally the side walls which are arranged between the base and the light source.

As the device for generating the cooling media flow is arranged in a cavity of the heat sink, a particularly compact design is achieved. The device for generating the cooling air flow is thus located within the outer contour of the heat sink, it is preferably completely enclosed by the heat sink and thus is particularly well protected from environmental effects.

Expediently, the heat sink includes cooling fins and/or cooling pins. As a result, the surface covered by the cooling media flow is maximized. By a suitable design of the cooling fins and/or cooling pins, the path of the cooling media flow may additionally be optimized.

As the cooling fins and/or cooling pins are arranged at least approximately parallel to a plane perpendicular to the base of the heat sink, it is ensured that the cooling media flow runs in the desired direction, whilst a very good thermal link is still provided between the cooling fins and/or cooling pins and the base of the heat sink.

The flow of the cooling media flow is also advantageously guided if the cooling fins and/or cooling pins are arranged approximately parallel to the plane of the base of the heat sink.

Advantageously, the heat sink has at least one lateral web. Said lateral web is particularly well-suited for accommodating other components of the heat sink. Also, a lateral web may be used to fasten the heat sink to other components.

Expediently, the cooling fins and/or cooling pins are arranged at least partially on the lateral web. As a result, cooling fins may also be arranged at a distance from the base which results in an improved discharge of heat, as the temperature of the air flowing past is generally lower at that point than in the vicinity of the base.

Expediently, the heat sink has at least one second base. Said base may be used to accommodate further components to be cooled, such as for example further light sources.

In an expedient development of the invention, the second base is in thermal cooperation with at least one electrical circuit, preferably a driver circuit for operating at least one light source of the lighting device. During operation, such components may also develop considerable waste heat and are thus effectively cooled by the heat sink. By the use of a second base, the heat sink is used as a connection member between the light source and driver circuit which results in a compact and simple design.

Expediently, in this case, the electrical circuit is arranged on the at least second base, as in this manner a particularly simple design is achieved.

It is also advantageous if the device for producing the cooling media flow is configured as a fan which may be electrically operated, in particular as an axial fan or radial fan. Such fans are simple and effective. However, it may also be advantageous to use a ventilation device, acting by means of an oscillating membrane or by means of accelerated ions.

Advantageously, the device for generating the cooling media flow is arranged in a cavity of the heat sink. As a result, a compact design is achieved and the device for generating the cooling media flow is reliably protected from environmental effects, in particular from the incursion of foreign bodies or from coming into contact with anything else.

As the cavity has at least partially a square or circular cross section, a simple design is achieved which is well-suited, in particular, for accommodating commercially-available electrical fans.

As the device for generating the cooling media flow is arranged on at least one of the lateral webs, said device is connected in a simple and reliable manner to the heat sink.

It is also advantageous if the lighting device has at least one standard base in order to be accepted into a standard lamp holder. Thus the lighting device may be fitted in conventional lamps, for example, in place of a different light source, such as for example an incandescent lamp or a fluorescent lamp.

The effects of the invention are particularly advantageous if the lighting device has light-emitting diodes as the light source and/or is configured as a so-called retrofit lamp. Retrofit lamps may be used instead of conventional incandescent lamps and mimic said lamps in their external dimensions. As a result, said retrofit lamps have to have a particularly compact design and have to operate as far as possible in all installation positions. Frequently, retrofit lamps have the conventional incandescent lamp (bulb) shape but, in particular, so-called candle lamps or reflector lamps i.e. lamps in which light is discharged by means of a reflector, may be understood thereby. Also linear lamps, i.e. lamps having a linear extension, may be included therein.

BRIEF DESCRIPTION OF THE DRAWINGS

The invention is intended to be described in more detail hereinafter with reference to exemplary embodiments. In the figures.

DETAILED DESCRIPTION

The following detailed description refers to the accompanying drawings that show, by way of illustration, specific details and embodiments in which the invention may be practiced.

Figure 1:
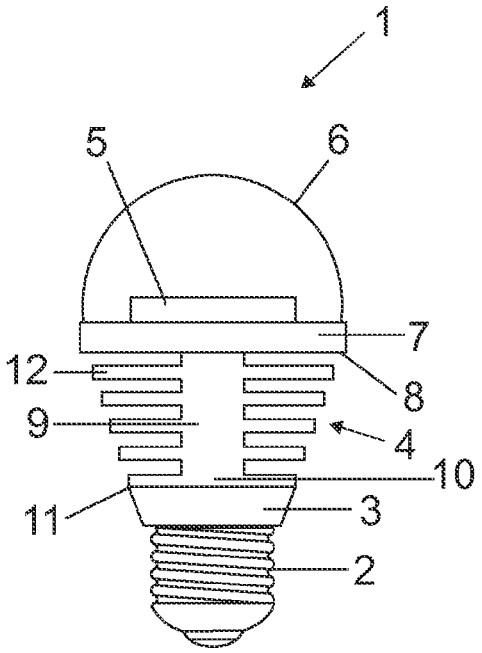
FIG. 1 shows a first exemplary embodiment of a lighting device according to the invention.

FIG. 1 shows as a first exemplary embodiment of a lighting device 1 according to the invention a so-called LED retrofit lamp 1 in a lateral sectional view. The lamp 1 has a conventional screw base 2 (a so-called Edison thread), drive electronics 3, a heat sink 4, light-emitting diodes (LED) 5 as the light source 5, as well as a bulb 6 which protects the LEDs 5 from environmental effects. The outer contour of the retrofit lamp 1 mimics the shape of a conventional incandescent lamp. The LEDs 5 are arranged on a first flat base 7 of the heat sink 4 and radiate into the upper half-space. On the side 8 of the first base 7 remote from the LEDs 5, the heat sink 4 has two lateral webs 9, of which in this case only the front lateral web is visible. At the end 10 of the lateral web 9 remote from the first base 7, a second flat base 11 is arranged parallel thereto and which bears the drive electronics 3 and thus is used for the cooling thereof.

To the side on the lateral webs 9, cooling fins 12 are attached which run parallel to the plane of the first base 7. An electrical fan 13, not visible here, is arranged between the lateral webs 9 and which is fastened to the lateral webs 9. The fan 13 is designed as an axial fan 13 and generates an air flow parallel to the plane of the base 7, the air entering the lamp 1 from the left-hand side and emerging again on the right-hand side.

Figure 2:
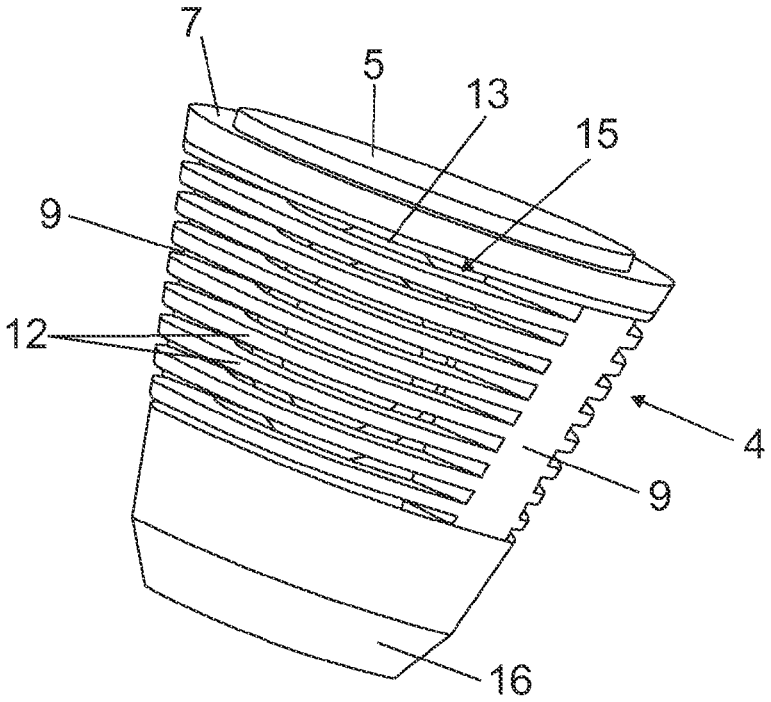
FIG. 2 shows a partial view of the lighting device according to FIG. 1 in perspective view.

The lower part 14 of the lamp 1 is reproduced in FIG. 2 in a perspective view. Light-emitting diodes 5 are attached to the upper base 7. The two lateral webs 9 as well as the axial fan 13 arranged in a cavity 15 of the heat sink 4 may be clearly seen. The cooling fins 12 also serve to protect the fan 13 from contact and from the incursion of foreign bodies. The drive electronics 3 are arranged for reasons of safety in a closed housing 16 made of an electrically-insulating material.

Figure 3:
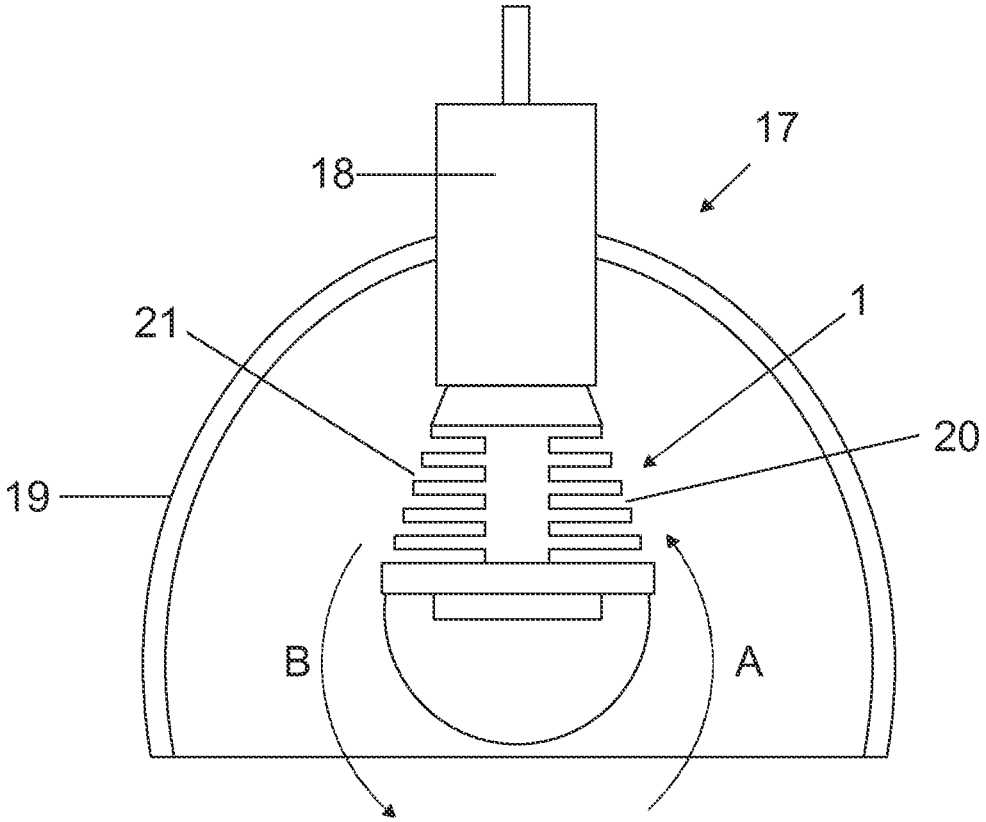
FIG. 3 shows the lighting device according to FIG. 1 installed in a typical lamp.

FIG. 3 shows the arrangement of such a lamp 1 in a suspended light fixture 17, which substantially consists of a lamp holder 18 and a lamp shade 19. The air flow of the drawn-in cold air (A) and the expelled heated air (B) is symbolized by the arrows A and B. It may be seen clearly that by the arrangement of the intake opening 20 and the air outlet opening 21 on opposing sides of the lamp 1, the heated-up expelled air is reliably prevented from being directly drawn back in.

Figure 4:
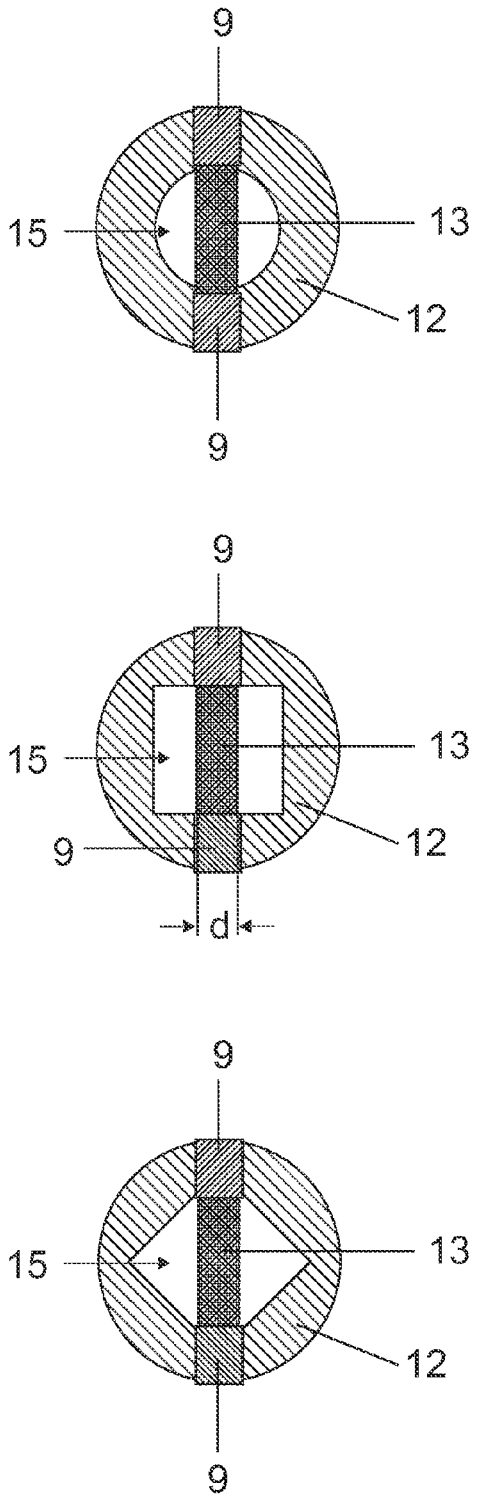
FIG. 4 shows three embodiments of a lighting device according to FIG. 1 in a sectional view.

FIG. 4 shows three different embodiments of the cavity 15, in which the axial fan 13 is arranged between the two lateral webs 9. By means of the free air space in front of and behind the fan 13, the cavity 15 serves to improve the efficiency thereof and to reduce the generation of noise. In FIG. 4, at the top, the cavity 15 has a circular cross section in a plane parallel to the plane of the first base 7. As a result, the cooling fins 12 have the same width over their entire periphery, which ensures effective heat discharge. In FIG. 4 in the middle, the cross section of the cavity 15 is square, which simplifies the installation of the fan 13 and due to the large installation space also permits the use of fans 13 of variable thickness d. FIG. 4 at the bottom shows a further embodiment of a square cross-sectional surface in which the width of the cooling fins 12 is reduced towards the point which is located on the outside and which is therefore the coolest point, ensuring effective discharge of heat with low material consumption for the cooling fins 12. Perpendicular to the plane of the base 7, the cavity 15 in the present exemplary embodiment has a rectangular cross section as the fan 13 may be easily inserted therein and a simple design facilitates the production of the heat sink 4. However, other cross-sectional shapes are also conceivable.

Figure 5:
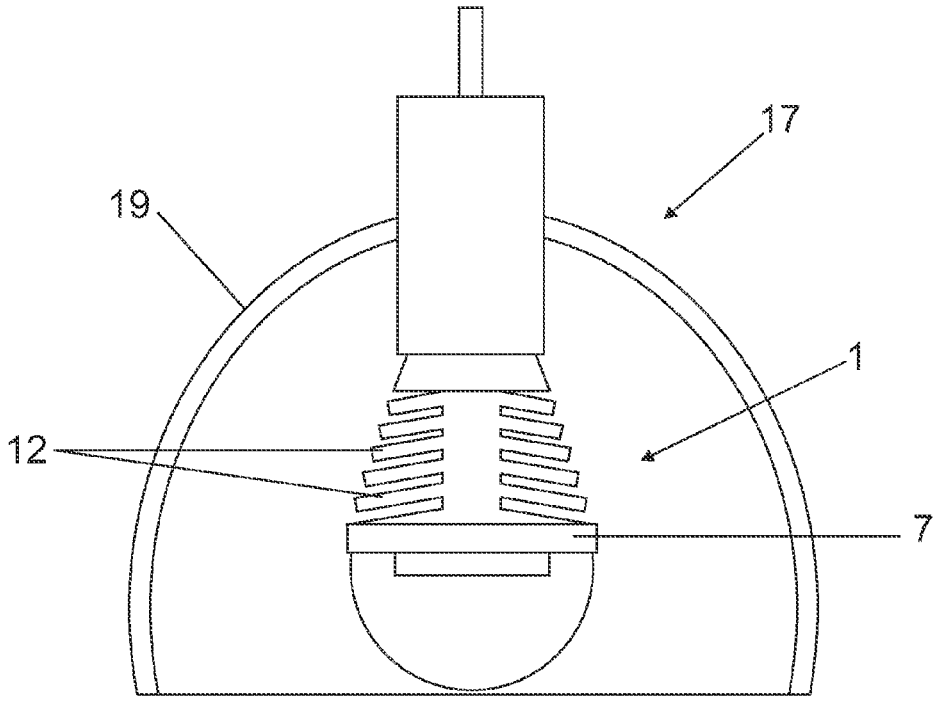
FIG. 5 shows a further embodiment of a lighting device according to the invention installed in a typical lamp.

FIG. 5 shows a further exemplary embodiment of a lighting device 1 according to the invention, also installed in a suspended light fixture 17. In this embodiment, the cooling fins 12 are attached in a slightly oblique manner, the distance from the first base 7 being reduced towards the outside. In this embodiment, although in contrast to the previous exemplary embodiment the air flow is no longer completely straight, it is still deflected by less than 90°, i.e. less than in the lighting device according to the prior art. In this arrangement, the direction in which the cooling air is sucked in or expelled, which is oriented away from the base 2 of the lamp 1 is advantageous and, as a result, produces effective cooling, in particular when using an open lamp shade 19.

Figure 6:
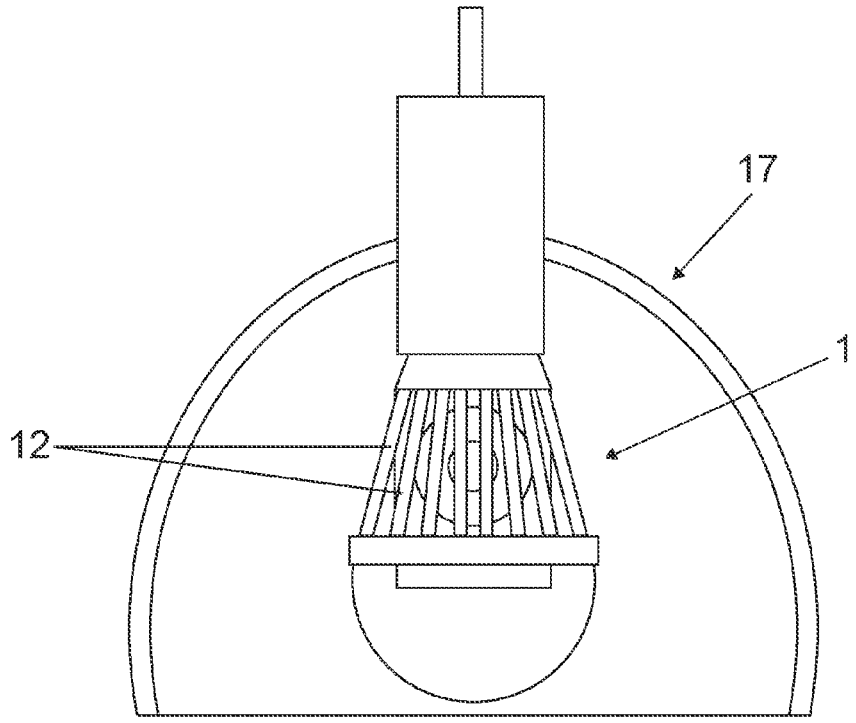
FIG. 6 shows a further embodiment of a lighting device according to the invention installed in a typical lamp.

In FIG. 6, a further exemplary embodiment is shown in which the cooling fins 12 are not oriented parallel to the first base 7 but approximately perpendicular thereto. Thus lateral webs 9 may be dispensed with. By the arrangement of the cooling fins 12 approximately parallel to the desired air flow direction, effective air guidance and thus an effective cooling action is achieved.

Naturally, further lighting devices 1 according to the invention are conceivable. Thus, for example, the arrangement of the cooling fins 12 may differ from those shown, by mixed shapes, with cooling fins 12 arranged perpendicular and parallel to the base 7, for example, or even the use of cooling pins being conceivable. Also, the arrangement of the lateral webs 9 and the fastening of the fan 13 may vary. Instead of the axial fan 13, further devices for generating a cooling media flow are also known to the person skilled in the art, in particular radial fans, systems based on an oscillating membrane or accelerated ions. Also, embodiments are conceivable in which a second base 11 may be dispensed with, by the drive electronics 3 being arranged, for example, on the base 7 carrying the LEDs 5. Also a thermal separation of the heat sink 4 is conceivable, so that heat transmission from the part operatively connected to the drive electronics 3 to the part operatively connected to the light source 5 is prevented or reduced. As a result, different levels of cooling may be applied to the two components.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lighting device, comprising:

at least one heat sink comprising a first base, a cooling support structure coupled to the first base, the cooling support comprising a plurality of cooling fins, a second base parallel to the first base and located below a cavity, the second base coupled to the cooling support structure, wherein the first base has a first surface facing away from the cavity and a second surface, opposite to the first surface, facing towards the cavity and towards the second base, wherein the first base, the second base, and the plurality of cooling fins define and surround the cavity, wherein each of the plurality of cooling fins is disposed parallel to the first surface or the second surface of the first base, and wherein each pair of adjacent cooling fins of the plurality of cooling fins define opposite boundaries of an opening between the cavity and an environment external to the lighting device, at least one light source arranged on the first surface of the first base; and at least one device connected to the lighting device configured to generate a cooling media flow, wherein the cooling media flow runs through the lighting device predominantly parallel to the second surface of the first base so that air substantially enters the lighting device externally from an opening at a first section of the cooling support structure and substantially emerges from the lighting device from an opening at a second section of the cooling support structure opposite the first section of the cooling support structure.

2. The lighting device as claimed in claim 1, wherein the cooling media flow runs substantially from a lateral surface of the cooling support structure to an opposing lateral surface of the lighting device.

3. The lighting device as claimed in claim 1, wherein the device configured to generate the cooling media flow is arranged in the cavity of the cooling support structure.

4. The lighting device as claimed in claim 1, wherein an exposed surface of each the plurality of cooling fins are arranged approximately parallel to the second surface of the first base.

5. The lighting device as claimed in claim 1, wherein the heat sink comprises at least one lateral web.

6. The lighting device as claimed in claim 5, wherein the plurality of cooling fins are arranged at least partially on the lateral web.

7. The lighting device as claimed in claim 1, wherein the second base is in thermal cooperation with at least one electrical circuit.

8. The lighting device as claimed in claim 7, wherein the electrical circuit is arranged on the second base.

9. The lighting device as claimed in claim 1, wherein the cavity has at least partially a square or circular cross section.

10. The lighting device as claimed in claim 5, wherein the device configured to generate the cooling media flow is arranged on at least one of the lateral webs.

11. The lighting device as claimed in claim 1, wherein the lighting device further comprises at least one standard base configured to be accommodated in a standard lamp holder.

12. The lighting device as claimed in claim 1, wherein the cooling media flow is an air flow.

13. The lighting device as claimed in claim 1, wherein the first base is approximately flat.

14. The lighting device as claimed in claim 7, wherein the electrical circuit is a driver circuit for operating at least one light source of the lighting device.

15. The lighting device of claim 1 further comprising a screw base.

16. The lighting device as claimed in claim 1, further comprising an electrical fan arranged in the cavity of the heat sink.

17. The lighting device as claimed in claim 1, further comprising a bulb coupled to the first base and at least partially surrounding the light source.

18. The lighting device as claimed in claim 1, wherein the light source is one or more light-emitting diodes.

19. The lighting device as claimed in claim 1, wherein the cooling support structure is coupled to the periphery of the first base and/or the second base.

20. A lighting device, comprising:

at least one heat sink comprising a cavity;

a first base, a cooling support structure coupled to the first base, the cooling support comprising a plurality of cooling fins, a second base parallel to the first base and located below the cavity, the second base coupled to the cooling support structure, wherein the first base has a first surface facing away from the cavity and a second surface, opposite to the first surface, facing towards the cavity and towards the second base, wherein the cavity is a hollow space extending from the first base to the second base that is bounded and unoccupied by the plurality of cooling fins, wherein each of the plurality of cooling fins is disposed parallel to the first surface or the second surface of the first base, and wherein each pair of adjacent cooling fins of the plurality of cooling fins define opposite boundaries of an opening between the cavity and an environment external to the lighting device, at least one light source arranged on the first surface of the first base; and at least one device connected to the lighting device configured to generate a cooling media flow, wherein the cooling media flow runs through the lighting device predominantly parallel to the second surface of the first base so that air substantially enters the lighting device externally from an opening at a first section of the cooling support structure and substantially emerges from the lighting device from an opening at a second section of the cooling support structure opposite the first section of the cooling support structure.

* * * * *